US005924065A

United States Patent [19]

Eberman et al.

[11] Patent Number: 5,924,065

[45] Date of Patent: Jul. 13, 1999

[54] ENVIRONMENTLY COMPENSATED SPEECH PROCESSING

[75] Inventors: Brian S. Eberman, Somerville; Pedro J. Moreno, Cambridge, both of Mass.

[73] Assignee: Digital Equipment Corporation, Maynard, Mass.

[21] Appl. No.: 08/876,601

[22] Filed: Jun. 16, 1997

[51] Int. Cl.[6] ..... G10L 3/02

[52] U.S. Cl. ..... 704/231; 704/226; 704/222

[58] Field of Search ..... 704/222, 226, 704/251, 233, 256, 231

[56] References Cited

U.S. PATENT DOCUMENTS

| | | | |
|---|---|---|---|
| 5,008,941 | 4/1991 | Sejnoha | 704/256 |
| 5,148,489 | 9/1992 | Erell et al. | 704/256 |
| 5,377,301 | 12/1994 | Rosenberg et al. | 704/222 |
| 5,469,529 | 11/1995 | Bimbot et al. . | |
| 5,598,505 | 1/1997 | Austin et al. | 704/226 |
| 5,727,124 | 3/1998 | Lee et al. | 704/233 |
| 5,745,872 | 4/1998 | Sonmez et al. | 704/222 |
| 5,768,474 | 6/1998 | Neti | 704/226 |

OTHER PUBLICATIONS

Acero, A., "Acoustical and Environmental Robustness in Automatic Speech Recognition," Ph.D. Thesis, CMU, Dept. of EECS, 1990.

Bimbot F., "Text–Free Speaker Recognition Using an Arithmetic–Harmonic Sphericity Measure," in Proc. Eurospeech 93, vol. 1, pp. 169–172, Sep. 1993.

Gish, H. and Schmidt, M., "Text–Independent Speaker Identification," IEEE Signal Pocessing Magazine, Oct. 1994.

Dempster, A., Laird, N.M., Rubin, D.B., "Maximum Likelihood from Incomplete Data via the EM Algorithm," Harvard University and Educational Testing Service, Dec. 8, 1976.

Leggetter, C.J. & Woodland, P.C., "Speaker Adaptation of HMMS Using Linear Regression," Cambridge University Engineering Department, Jun. 1994.

Gales, J.R., & Young, S.J., "Robust Continuous Speech Recognition Using Parallel Model Combination," Cambridge University Engineering Department, Mar. 1994.

Gales, J.F., & Young, S.J., "Parallel Model Combination for Speech Recognition in Noise," Cambridge University Engineering Department, Jun. 1993.

(List continued on next page.)

*Primary Examiner*—David R. Hudspeth
*Assistant Examiner*—Daniel Abebe

[57] ABSTRACT

In a computerized method for processing speech signals, first vectors representing clean speech signals are stored in a vector codebook. Second vectors are determined from dirty speech signals. Noise and distortion parameters are estimated from the second vectors. Third vectors are predicated, based on estimated noise and distortion parameters. The third vectors are used to correct the first vectors. The third vectors can then be applied to the second vectors to produce corrected vectors. The corrected vectors and the first vectors can be compared to identify first vectors which resemble the corrected vectors.

12 Claims, 9 Drawing Sheets

OTHER PUBLICATIONS

Gauvain, L., Lamel, L., Adda, G., & Matrouf, D., "Developments in Continuous Speech Dictation using the 1995 ARPA NAB News Task," In Proceedings: ICASSP 96, 1996 Int. Conf. on Acoustics, Speech, and Signal Processing, 1996.

Neumeyer, L. and Weintraub, M., "Probabilistic Optimum Filtering for Robust Speech Recognition," In Proc: ICASSP 94, 1994 Int. Conf. on Acoustics, Speech, and Signal Processing, vol. I, pp. 417–420, May 1994.

Liu, F., Acero, A. & Stern, R., "Efficient Joint Compensation of Speech for the Effects of Additive Noise and Linear Filtering," In Proc: ICASSP 92, 1992 Int. Conf. on Acoustics, Speech, and Signal Processing, vol. I, pp. 257–260, Mar. 1992.

Zhang, X. & Mammone, R., "Channel and Noise Normalization Using Affine Transformed Cepstrum," In Int. Conf. on Speech and Language Processing, 1996.

Acero, A. & Stern, R., "Robust Speech Recognition by Normalization of the Acoustic Space," Department of Electrical and Computer Engineering and School of Computer Science.

Moreno, P., Raj, B., and Stern, R., "A Vector Taylor Series Approach for Environment–Independent Speech Recognition," Department of Electrical and Computer Engineering & School of Computer Science.

ENVIRONMENTLY COMPENSATED SPEECH PROCESSING

FIELD OF THE INVENTION

The present invention relates generally to speech processing, and more particularly to compensating digitized speech signals with data derived from the acoustic environment in which the speech signals are generated and communicated.

BACKGROUND OF THE INVENTION

Over the next years, speech is expected to become one of the most used input modalities for interacting with computer systems. In addition to keystrokes, mouse clicks, and visible body gestures, speech can improve the way that users interact with computerized systems. Processed speech can be recognized to discern what we say, and even who we are. Speech signals are increasingly being used to gain access to computer systems, and to operate the systems using voiced commands and information.

If the speech signals are "clean," and produced in an acoustically pristine environment, then the task of processing the signals to produce good results is relatively straightforward. However, as we use speech in a larger variety of different environments to interact with systems, for example, offices, homes, roadside telephones, or for that matter anywhere where we can carry a cellular phone, compensating for acoustical differences in these environments becomes a dominant problem in order to provide robust speech processing.

Generally, two types of effects can cause clean speech to become "dirty." The first effect is distortion of the speech signals themselves. The acoustic environment can distort audio signals in an innumerable number of ways. Signals can unpredictably be delayed, advanced, duplicated to produce echoes, change in frequency and amplitude, and so forth. In addition, different types of telephones, microphones and communication lines can introduce yet another set of different distortions.

The second soiling effect is "noise." Noise is due to additional signals in the speech frequency spectrum that are not part of the original speech. Noise can be introduced by other people talking in the background, office equipment, cars, planes, the wind, and so forth. Thermal noise in the communications channels can also add to the speech signals. The problem of processing dirty speech is compounded by the fact that the distortions and noise can change dynamically over time.

Generally, robust speech processing includes the following steps. In a first step, digitized speech signals are partitioned into time aligned portions (frames) where acoustic features can generally be represented by linear predictive coefficient (LPC) "feature" vectors. In a second step, the vectors can be cleaned up using environmental acoustic data. That is, processes are applied to the vectors representing dirty speech signals so that a substantial amount of the noise and distortion is removed. The cleaned-up vectors, using statistical comparison methods, more closely resemble similar speech produced in a clean environment. Then in a third step, the cleaned feature vectors can be presented to a speech processing engine which determines how the speech is going to be used. Typically, the processing relies on the use of statistical models or neural networks to analyze and identify speech signal patterns.

In an alternative approach, the feature vectors remain dirty. Instead, the pre-stored statistical models or networks which will be used to process the speech are modified to resemble the characteristics of the feature vectors of dirty speech. This way a mismatch between clean and dirty speech, or their representative feature vectors can be reduced.

By applying the compensation on the processes (or speech processing engines) themselves, instead on the data, i.e., the feature vectors, the speech analysis can be configured to solve a generalized maximum likelihood problem where the maximization is over both the speech signals and the environmental parameters. Although such generalized processes have improved performance, computationally, they tend to be more intensive. Consequently, prior art applications requiring real-time processing of dirty speech signals are more inclined to condition the signal, instead of the processes, leading to less than satisfactory results.

Compensated speech processing has become increasingly more sophisticated in recent years. Some of the earliest processes use ceptral mean normalization (CMN) and relative spectral (RASTA) methods. These methods are two versions of the same mean substraction method. There, the idea is to subtract an estimate of the measured speech from incoming frames of speech. Classical CMN subtracts the mean representing all of the measured speech from each speech frame, while RASTA subtracts a "lag" estimate of the mean from each frame.

Both the CMN and the RASTA methods compensate directly for differences in channels characteristics resulting in improved performance. Because both methods use a relatively simple implementation, they are frequently used in many speech processing systems.

A second class of efficient compensation methods relies on stereo recordings. One recording is taken with a high performance microphone for which the speech processing system has already been trained, another recording is taken with a target microphone to be adapted to the system. This approach can be used to provide a boot-strap estimate of speech statistics for retraining. Stereo-pair methods that are based on simultaneous recordings of both the clean and dirty speech are very useful for this problem.

In a probabilistic optimum filtering (POF) method, a vector codebook (VQ) is used. The VQ describes the distribution of mel-frequency ceptral coefficients (MFCC) of clean speech combined with a codeword dependent multidimensional transversal filter. The purpose of the filter is to acquire temporal correlations between frames of speech displaced in time. POF "learns" the parameters of each frame dependent VQ filter (a matrix) and each environment using a minimization of a least-squares error criteria between the predicted and measured speech.

Another known method, Fixed Codeword Dependent Ceptral Normalization (FCDCN), similar to the POF method, also uses a VQ representation for the distribution of the clean speech ceptrum vectors. This method computes codeword dependent correction vectors based on simultaneously recorded speech. As an advantage, this method does not require a modeling of the transformation from clean to dirty speech. However, in order to achieve this advantage, stereo recording is required.

Generally, these speech compensation methods do not make any assumptions about the environment because the effect of the environment on the ceptral vectors is directly modeled using stereo recordings.

In one method, Codeword Dependent Ceptral Normalization (CDCN), the ceptra of clean speech signals are modeled using a mixture of Gaussian distributions where each Gaussian can be represented by its mean and covariance. The CDCN method analytically models the effect of the environment on the distribution of the clean speech ceptra.

In a first step of the method, the values of the environmental parameters (noise and distortion) are estimated to maximize the likelihood of the observed dirty ceptrum vectors. In a second step, a minimum mean squared estimation (MMSE) is applied to discover the unobserved ceptral vectors of the clean speech given the ceptral vectors of the dirty speech.

The method typically works on a sentence-by-sentence or batch basis, and, therefore, needs fairly long samples (e.g., a couple of seconds) of speech to estimate the environmental parameters. Because of the latencies introduced by the batching process, this method is not well suited for real-time processing of continuous speech signals.

A parallel combination method (PMC) assumes the same models of the environment as used in the CDCN method. Assuming perfect knowledge of the noise and channel distortion vectors, the method tries to transform the mean vectors and the covariance matrices of the acoustical distribution of hidden Markov models (HHM) to make the HHM more similar to an ideal distribution of the ceptra of dirty speech.

Several possible alternative techniques are known to transform the mean vectors and covariance matrices. However, all these variations of the PMC require prior knowledge of noise and channel distortion vectors. The estimation is generally done beforehand using different approximations. Typically, samples of isolated noise are required to adequately estimate the parameters of the PMC. These methods have shown that distortion in the channel effects the mean of the measured speech statistics, and that the effective SNR at a particular frequency controls the covariance of the measured speech.

Using a vector Taylor series (VTS) method for speech compensation, this fact can be exploited to estimate the dirty speech statistics given clean speech statistics. The accuracy of VTS method depends on the size of the higher order terms of the Talyor series approximation. The higher order terms are controlled by the size of the covariance of the speech statistics.

With VTS, the speech is modeled using a mixture of Gaussian distributions. By modeling the speech as a mixture, the covariance of each individual Gaussian is smaller than the covariance of the entire speech. In order for VTS to work, it can be shown that the mixture model is necessary to solve the maximization step. This is related to the concept of sufficient richness for parameter estimation.

In summary, the best known compensation methods base their representations for the probability density function p(x) of clean speech feature vectors on a mixture of Gaussian distributions. The methods work in batch mode, i.e., the methods needs to "hear" a substantial amount of signal before any processing can be done. The methods usually assume that the environmental parameters are deterministic, and therefore, are not represented by a probability density function. Lastly, the methods do not provide for an easy way to estimate the covariance of the noise. This means that the covariance must first be learned by heuristic methods which are not always guaranteed to converge.

It is desired to provide a speech processing system where clean speech signals can naturally be represented. In addition, the system should work as a filter so that continuous speech can be processed as it is received without undue delays. Furthermore, the filter should adapt itself as environmental parameters which turn clean speech dirty change over time.

SUMMARY OF THE INVENTION

Provided is a computerized method for compensating continuous dirty speech signals using estimations of environmental noise and distortion parameters Q, H, and $\Sigma_n$. In the method, first feature vectors representing clean speech signals are stored in a vector codebook. Second vectors are determined for dirty speech signals including noise and distortion parameterized by Q, H, and $\Sigma_n$.

The noise and distortion parameters are estimated from the second vectors. Using the estimated parameters, third vectors are estimated. The third vectors are applied to the second vectors to produce corrected vectors which can be statistically compared to the first vectors to identify first vectors which best resemble the corrected vectors.

In one aspect of the invention the third vectors can be stored in the vector codebook. During the comparison, a distance between a particular corrected vectors and a corresponding first vectors can be determined. The distance represents a likelihood that the first vector resembles the corrected vector. Furthermore, the likelihood that the particular corrected vector resembles the coresponding first vector is maximized.

In a speech recognition system, the corrected vectors can be used to determine the phonetic content of the dirty speech to perform speech recognition. In a speaker identification system, the corrected vectors can be used to determine the identity of an unknown speaker producing the dirty speech signals.

In another aspect of the invention, the third vectors are dynamically adapted as the noise and distortion parameters alter the dirty speech signals over time.

DETAILED DESCRIPTION OF PREFERRED EMBODIMENTS

Figure 1:
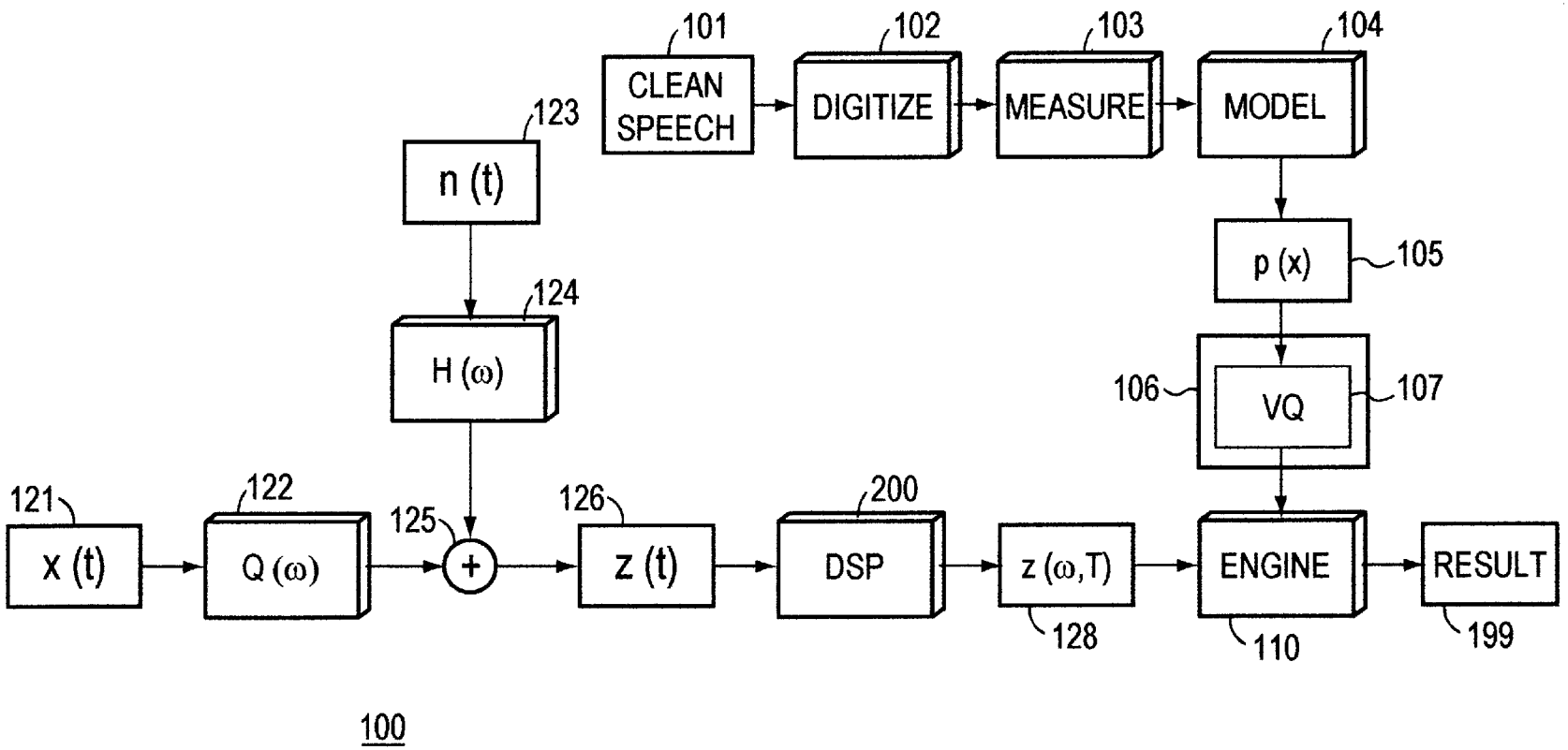
FIG. 1 is a flow diagram of a speech processing system according to the invention.

FIG. 1 is an overview of an adaptive compensated speech processing system 100 according to a preferred embodiment of the invention. During a training phase, clean speech signals 101 are measured by a microphone (not shown). Hereinafter, clean speech means speech which is free of noise and distortion.

The clean speech 101 is digitized 102, measured 103, and statistically modeled 104. The modeling statistics p(x) 105 that are representative of the clean speech 101 are stored in a memory as entries of a vector codebook (VQ) 106 for use by a speech processing engine 110. After training, the system 100 can be used to process dirty speech signals.

During this phase, speech signals x(t) 121 are measured using a microphone which has a power spectrum Q(ω) 122 relative to the microphone used during the above training phase. Due to environmental conditions extant during actual use, the speech x(t) 121 is dirtied by unknown additive stationary noise and unknown linear filtering, e.g., distortion n(t) 123. These additive signals can be modeled as white noise passing through a filter with a power spectrum H(ω) 124.

Note, adding the noise and distortion here (125), or before the signals x(t) 121 are measured by the microphone are structurally equivalent. In any case, real-world environmental conditions result in dirty speech signals z(t) 126. The dirty speech signals 126 are processed by a digital signal processor (DSP) 200.

Figure 2:
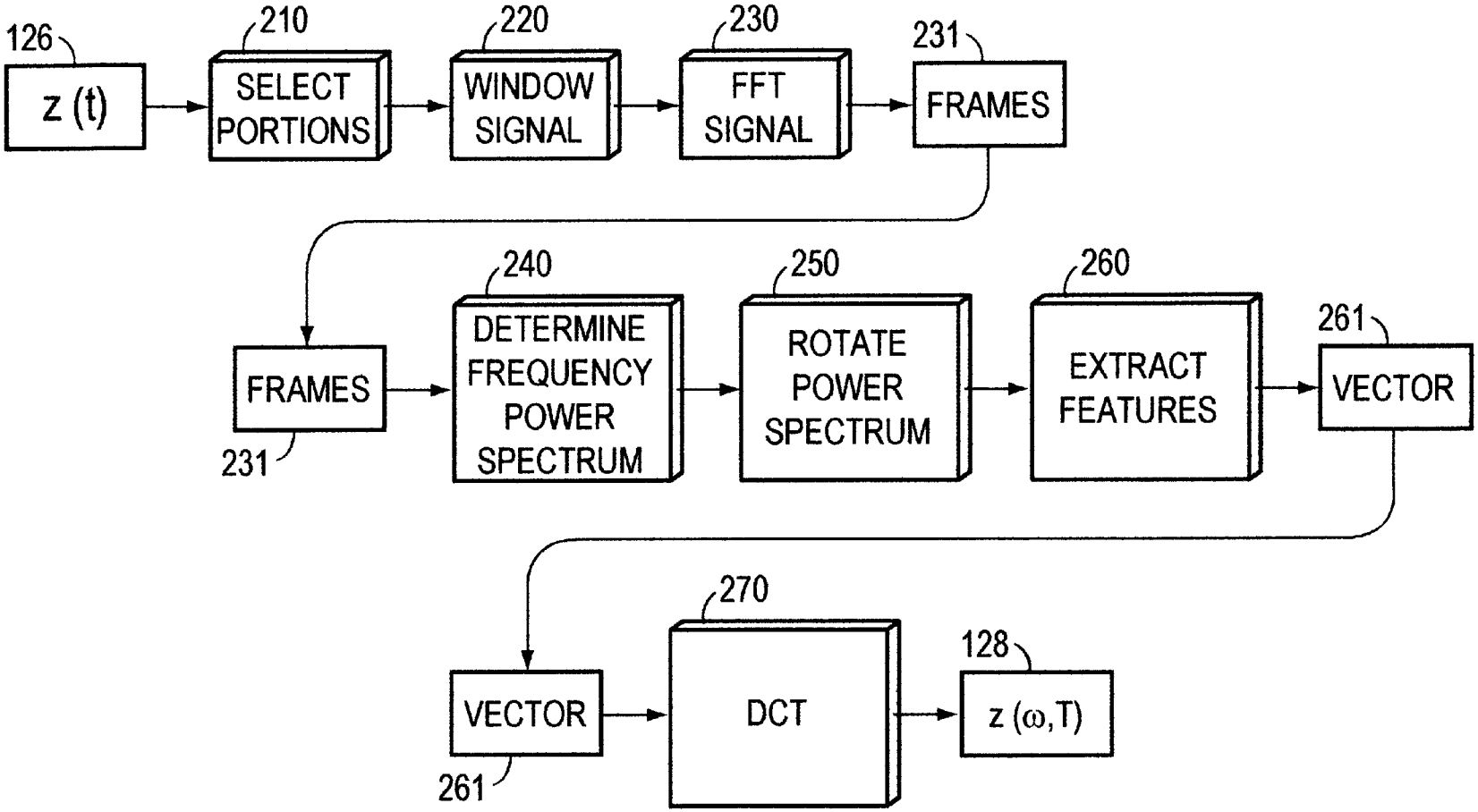
FIG. 2 is a flow diagram of a process to extract feature vectors from continuous speech signals.

FIG. 2 shows the details of the DSP 200. The DSP 200 selects (210) time-aligned portions of the dirty signals z(t) 126, and multiplies the portion by a well known window function, e.g., a Hamming window. A fast Fourier transform (FFT) is applied to windowed portions 220 in step 230 to produce "frames" 231. In a preferred implementation, the selected digitized portions include 410 samples to which a 410 point Hamming window is applied to yield 512 point FFT frames 231.

Next, the frequency power spectrum statistics for the frames 231 are determined in step 240 by taking the square magnitude of the FFT result. Half of the FFT terms can be dropped because they are redundant leaving 256 point power spectrum estimates. In step 250, the spectrum estimates are rotated into a mel-frequency domain by multiplying the estimates by a mel-frequency rotation matrix. Step 260 takes the logarithm of the rotated estimates to yield a feature vector representation 261 for each of the frames 231.

Further possible processing in step 270 can include applying a discrete cosine transform (DCT) to the mel-frequency log spectrum to determine the mel cepstrum. The mel frequency transformation is optional, without it, the result of the DCT is simply termed the cepstrum.

During the processing, the window function moves along the measured dirty signals z(t) 126. The steps of the DSP 200 are applied to the signals at each new location of the Hamming window. The net result is a sequence of feature vectors z(ω, T) 128. The vectors 128 can be processed by the engine 110 of FIG. 1. The vectors 128 are statistically compared with entries of the VQ 107 to produce results 199.

It can be shown that noise and channel distortion effect the vectors 128 as:

$$z(\omega,T)=\log\left(\exp\left(Q(\omega)+x(\omega,T)\right)+\exp\left(H(\omega)+n(\omega,T)\right)\right) \quad \text{[Eg. 1]}$$

where x(ω,T) are the underlying clean vectors that would have been measured without noise and channel distortion, and n(ω,T) are the statistics if only the noise and distortion were present.

Without the noise, the power spectrum Q(ω) 122 of the channel produces a linear distortion on the measured signals x(t) 121. The noise n(t) 123 is linearly distorted in the power spectrum domain, but non-linearly in the log spectral domain. Lastly note, the engine 110 has access to a statistical representation of x(ω,T), e.g., VQ 107. The present invention uses this information to estimate the noise and distortion.

The effect of the noise and distortion on the speech statistics can be determined by expanding Equation 1 about the mean of the clean speech vectors using a first order Taylor series expansion of:

$$E[z]=Q+E[x]+\log(1+1/b)$$

to produce:

$$\Sigma_{z-diag}(b/b+1)\Sigma_x\mathrm{diag}(b/b+1)+\mathrm{diag}(1/b+1)\Sigma_N\mathrm{diag}(1/b+1) \quad \text{[Eq. 2]}$$

Here, the dependence of the terms on frequency and time have been dropped for clarity. This shows that the effect of distortion depends on the signal-to-noise ratio, which can be expressed as:

$$b=\exp(Q+E[x]-H-E[n]) \quad \text{[Eq. 3]}$$

Equations 2 and 3 show that the channel linearly shifts the mean of the measured statistics, decreases the signal-to-noise ratio, and decreases the covariance of the measured speech because the covariance of the noise is smaller than the covariance of the speech.

Based on this analysis, the present invention uniquely combines the prior art methods of VTS and PMC, described above, to enable a compensated speech processing method which adapts to dynamically changing environmental parameters that can dirty speech.

The invention uses the idea that the training speech can naturally be represented by itself as vectors p(x) 105 for the purpose of environmental compensation. Accordingly, all speech is represented by the training speech vector codebook (VQ) 107. In addition, differences between clean training speech and actual dirty speech are determined using an Expectation Maximization (EM) process. In the EM process described below, an expectation step and a maximization step are iteratively performed to converge towards an optimal result during a gradient ascent.

The stored training speech p(x) 105 can be expressed as:

$$p(x)=\sum_i P_i\delta(x-v_i)$$

where the collection $\{v_i\}$ represents the codebook for all possible speech vectors, and $P_i$ is the prior probability that the speech was produced by the corresponding vector.

Although this representation may not be appropriate for speech recognition, unless the size of the codebook is very large, it is an excellent representation for robustness parameters estimation and compensation. This is true because a robust speech processing system only needs to estimate some overall parametric statistic which can be estimated from the distribution using the EM process.

Figure 3:
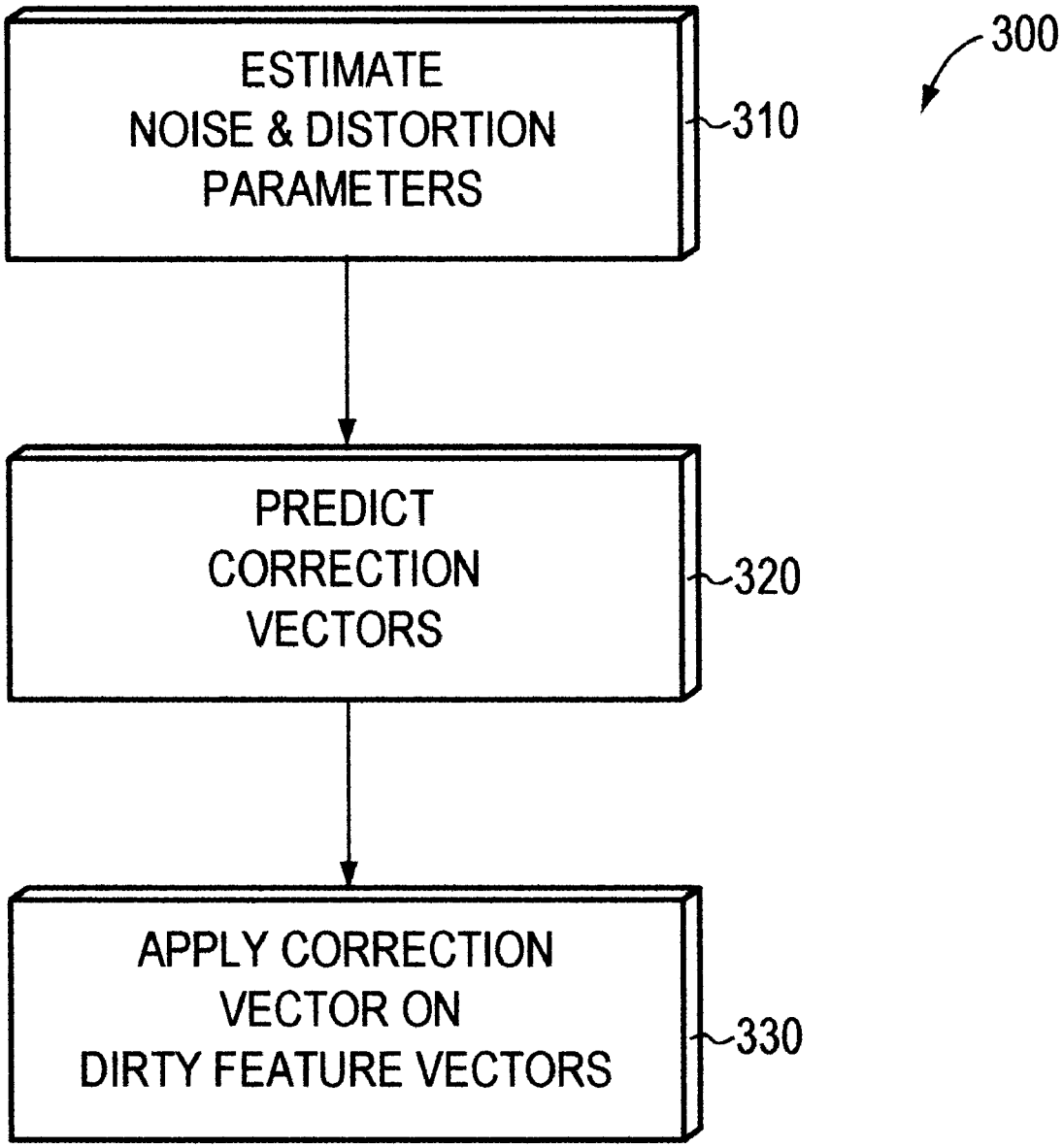
FIG. 3 is a flow diagram for an estimation maximization process.

As shown in FIG. 3, the compensation process 300 comprises three major stages. In a first stage 310 using the EM process, parameters of the noise and (channel) distortion are determined so that when the parameters are applied to the vector codebook 107, the codebook maximizes the likelihood that the transformed codebook best represents the dirty speech.

In a second stage 320 after the EM process has converged, a transformation of the codebook vector 107 is predicted given the estimated environmental parameters. The transformation can be expressed as a set of correction vectors.

During a third stage 330, the corrected vectors are applied to the feature vectors 128 of the incoming dirty speech to make them more similar, in a minimum mean square error (MMSE) sense, to the clean vectors stored in the VQ 107.

As an advantage, the present compensation process 300 is independent of the processing engine 110, that is, the compensation process operates on the dirty feature vectors, correcting the vectors so that they closely resemble vectors derived from clean speech not soiled by noise and distortion in the environment.

Figure 4:
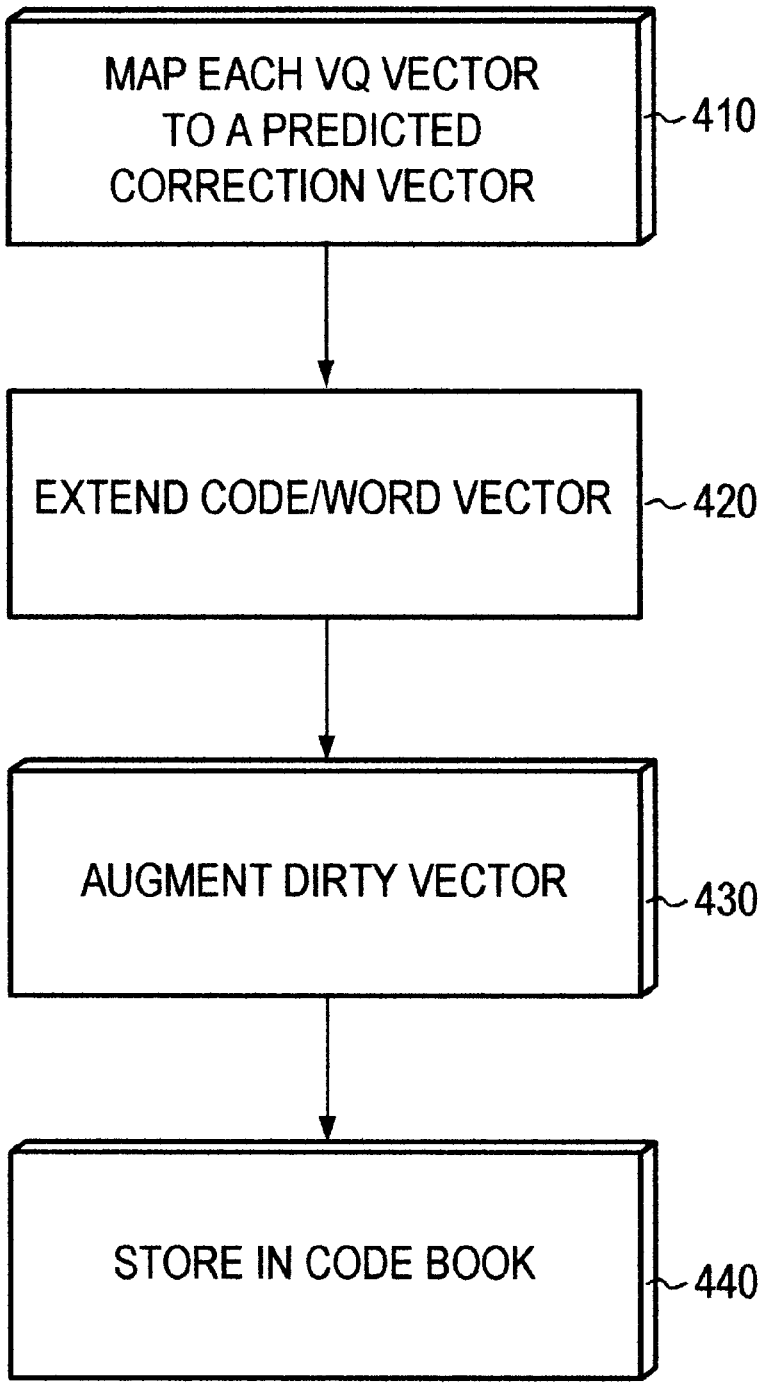
FIG. 4 is a flow diagram for predicting vectors.

The details of these stages are now discussed in greater detail. As shown in FIG. 4, the EM stage iteratively determines the three parameters $\{Q, H, \Sigma_n\}$ that specify the environment. The first step 410 is a predictive step. The current values of $\{Q, H, \Sigma_n\}$ are used to map each vector in the codebook 107 to a predicted correction vector $V'_i$ using Equation 1, for each:

$$V'_i \leftarrow \log(\exp(Q + v_i) + \exp(H)). \quad \text{[Eq. 4]}$$

Here, the value E[n] has been absorbed in the value of H. The first derivative of this relationship with respect to noise is:

$$F_1(i, j) = \delta(i - j)\frac{\exp(H_i)}{\exp(Q_i + x_i)}$$

where $\delta(i-j)$ is the Kronker delta.

Each predicted codeword vector $V'_i$ is then extended 420 by its prior which is transformed as:

$$\sqrt{-1/2\log(P_i)}$$

Each dirty speech vector is also augmented 430 by a zero. In this way, it is possible to directly compare augmented dirty vectors and augmented $V'_i$ codewords. The fully extended vector $V'_i$ has the form:

$$\begin{bmatrix} V'_i \\ \sqrt{-1/2\log(P_i)} \end{bmatrix},$$

and the augmented dirty vector has the form:

$$z_t^e = \begin{bmatrix} z_t \\ 0 \end{bmatrix},$$

The resulting set of extended correction vectors can then be stored (440) in the vector codebook VQ. For example, each entry of the codebook can have a current associated extended correction vector reflecting the current state of the acoustic environment. The extended correction vectors have the property that −½ times the distance between a codebook vector and a corresponding dirty speech vector 128 can be used as the likelihood that a dirty vector $z_t$ is represented a codeword vector $v_i$.

Figure 5:
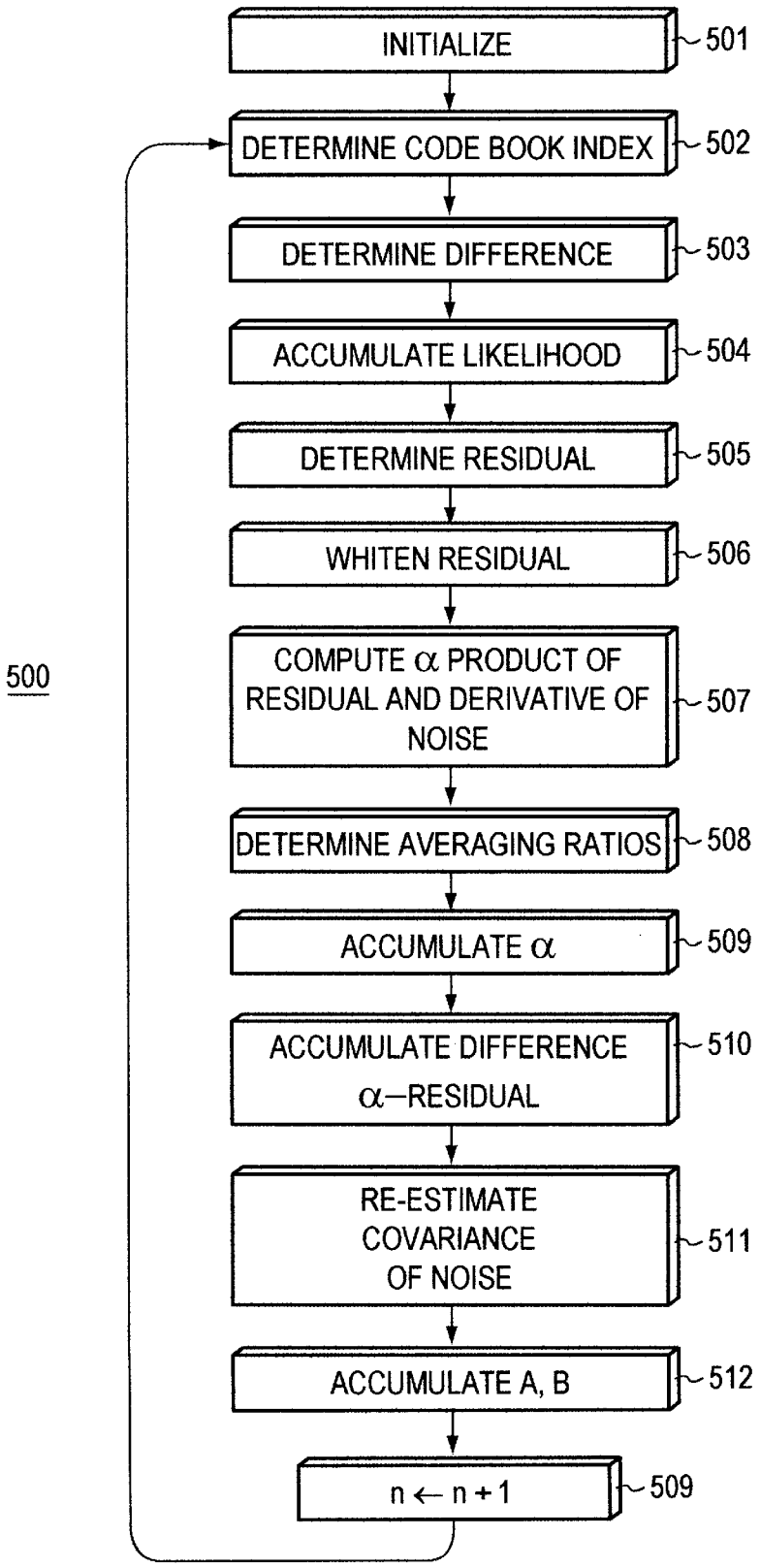
FIG. 5 is a flow diagram for determining differences between vectors.

FIG. 5 shows the steps 500 of the expectation stage in greater detail. During this stage, the best match between one of the incoming dirty vectors 128 and a (corrected) codebook vector is determined, and statistics needed for the maximization stage are accumulated. The process begins by initializing variables L, N, n, Q, A, and B to zero in step 501.

As shown in FIG. 5 for each incoming dirty vector 128, the following steps are performed. First in step 502 determine an entry in the new vector codebook $VQ(z^e)$ which best resembles the transformed vector. Note, that the intial correction vectors in the codebook associated with the clean vectors can be zero, or estimated. The index to this entry can be expressed as:

$$j(i) - \arg\min[k] \| VQ(z^e_k), [z'_i, 0] \|^2.$$

In addition, the squared distance ($d(z'_i)$) between the best codebook vector and the incoming vector is also returned in step 503. This distance, a statistical difference between the selected codebook vector and the dirty vector, is used to determine likelihood of the measured vector as:

$$l(z_i) \leftarrow ½d(z_i).$$

Note, as stated above, the resulting likelihood is the posterior probability that the measured dirty vector is in fact represented by the codebook vector. Next, the likelihood $l(z_i)$ is accumulated(504) as:

$L=L+l(z_i)$, and the residual $v_i$ is determined in step 505. In step 506, the residual is whitened with a Gaussian distribution.

Next, at step (507) are computed the product of the residual, and the first derivative with respect to the noise $\alpha \leftarrow F(j(i))v$. This operation can be done using a point-wise multiplication since F(j(i)) is a diagonal matrix.

This is followed by determining (508) the averaging ratios where $r_i=n/(n+1)$ and $r_2=1/(n+1)$. Here, n is the total number of measured vectors used so far during the iterations. The products determined in step 507 are accumulated in step 509. The differences between the products of step 509, and the residual are accumulated in step 510 as:

$Qs \leftarrow r_i Qs + r_2(v^*_i - \alpha)$. Then in step 511, the covariance of the noise is re-estimated. Finally in step 512 the variable A is accumulated as:

$A \leftarrow r_1 A + r_2(F_1(j(i)^T \Sigma_n^{-1} F_1(j(i)))$, and the variable B as:

$B \leftarrow r_1 B + r_2 \Sigma_n^{-1} F_1(j(i))$.

The accumulated variables of the current estimation iteration are then used in the maximization stage. The maximization involves solving the set of linear equations:

$$\begin{bmatrix} \sum_n^{-1} & -B & -B^T & +A & +\sum_Q^{-1} & -A & +B \\ & & -A & +B^T & & A & +\sum_N^{-1} \end{bmatrix} \delta = \begin{bmatrix} Q_s \\ N_s \end{bmatrix}$$

where $\Sigma_Q$ and $\Sigma_N$ represent a priori covariances assigned to the Q and N parameters.

The resulting value is then added to the current estimation of the environmental parameters. After the EM process has converged, which can be determined by monitoring the likelihood, the final two phases can be performed depending on the desired speech processing application. The first step predicts the statistics of the dirty speech given the estimated parameters of the environment from the EM process. This is equivalent to the prediction step of the EM process. The second step uses the predicted statistics to estimate the MMSE correction factors.

Speech Recognition

Figure 6:
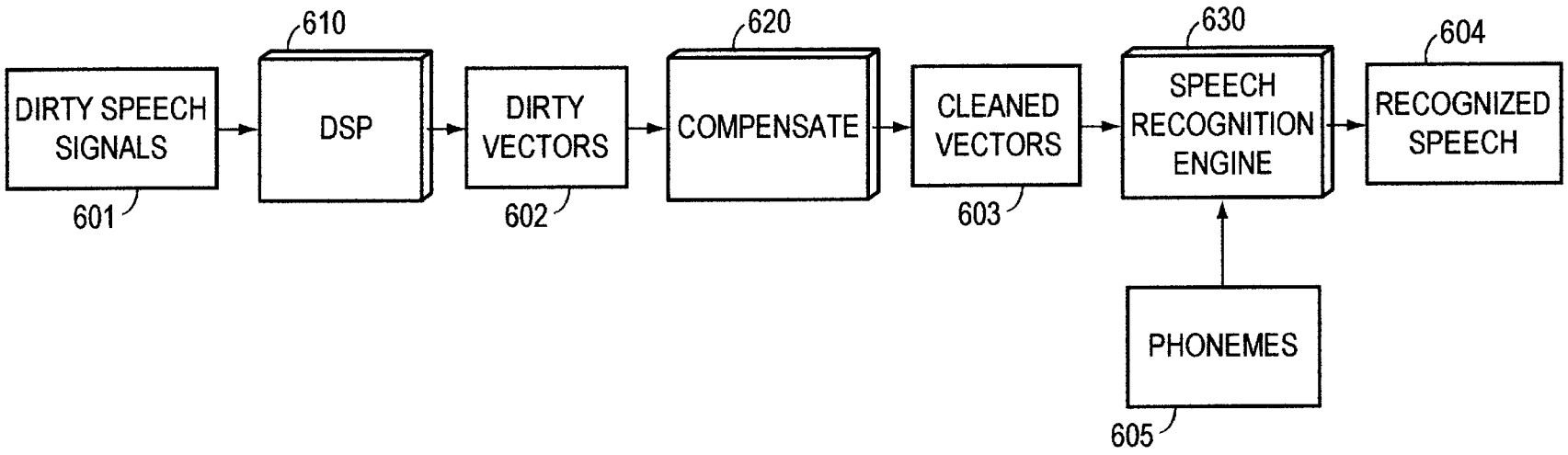
FIG. 6 is a flow diagram for a process for recognizing speech.

As shown in FIG. 6, a first application where environmentally compensated speech can be used is in a speech recognition engine. Here, it is desired to determine what is being said. This application would be useful to recognize speech acquired over a cellular phone network where noise and distortion tend to be higher than in plain old telephone services (POTS). This application can also be used in speech acquired over the World Wide Web where the speech can be generated in environments all over the world using many different types of hardware systems and communications lines.

As shown in FIG. 6, dirty speech signals 601 are digitally processed (610) to generate a temporal sequence of dirty feature vectors 602. Each vector statistically represents a set of acoustic features found in a segment of the continuous speech signals. In step 620, the dirty vectors are cleaned to produce "cleaned" vectors 603 as described above. That is the invention is used to remove any effect the environment could have on the dirty vectors. Note, the speech signals to be processed here are continuous. Unlike in batched speech processing, operating on short bursts of speech, here the compensation process needs to behave as a filter.

A speech recognition engine 630 matches the cleaned vectors 603 against a sequence of possible statistical parameters representing known phonemes 605. The matching can be done in an efficient manner using an optimal search algorithm such as a Viterbi decoder that explores several possible hypotheses of phoneme sequences. A hypothesis sequence of phonemes closest in a statistical sense to the sequence of observed vectors is chosen as the uttered speech.

Figure 7:
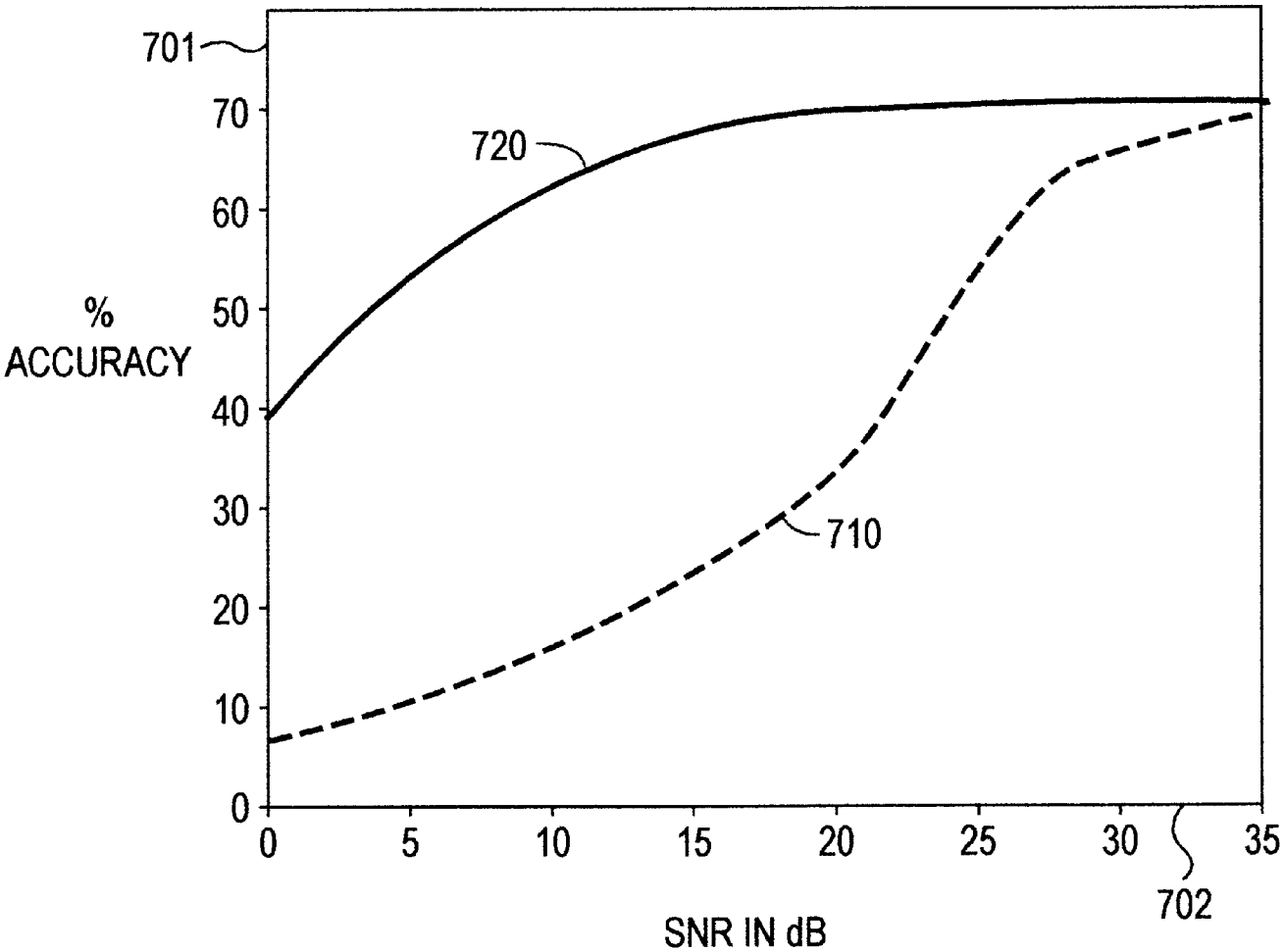
FIG. 7 is a graph comparing the accuracy of speech recognition methods.

As shown in FIG. 7, using the compensation as disclosed herein for speech recognition, results in an increased robustness to background noise for phonetic classification tasks. In FIG. 7, the y-axis 701 indicates the percentage of accuracy in hypothesizing the correct speech, the x-axis 702 indicates that relative level of noise (SNR). Broken curve 710 is for uncompensated speech recognition, and solid curve 720 is for compensated speech recognition. As can be seen, there is a significant improvement at all SNR below about 25 dB, which is typical for an office environment.

Speaker Recognition

Figure 8:
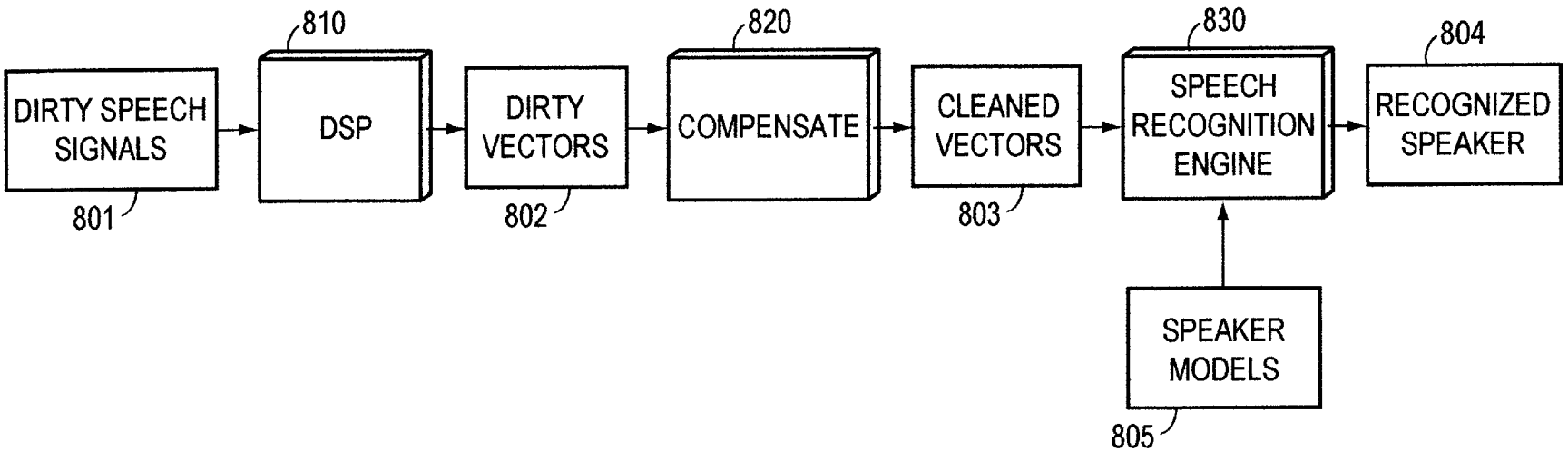
FIG. 8 is a flow diagram of a process for recognizing speakers.

In this application shown in FIG. 8, it is desired to determine who the speaker is independent on what the speaker says. Here, dirty speech signals 801 of an unknown speaker are processed to extract vectors 810. The vectors 810 are compensated (820) to produce cleaned vectors 803. The vectors 803 are compared against models 805 of known speakers to produce an identification (ID) 804. The models 805 can be acquired during training sessions.

Here as above, the noisy speech statistics are first predicted given the values of the environmental parameters estimated in the expectation maximization phase. Then, the predicted statistics are mapped into final statistics to perform the required processing on the speech.

Several possible techniques can be used. In one technique, the mean and covariance are determined for the predicted statistics. Then, the likelihood that an arbitrary utterance was generated by a particular speaker can be measured as the arithmetic harmonic sphericity (AHS) or the maximum likelihood (ML) distance.

Another possible technique uses the likelihood determined by the EM process. In this case, no further computations are necessary after the EM process converges.

Figure 9:
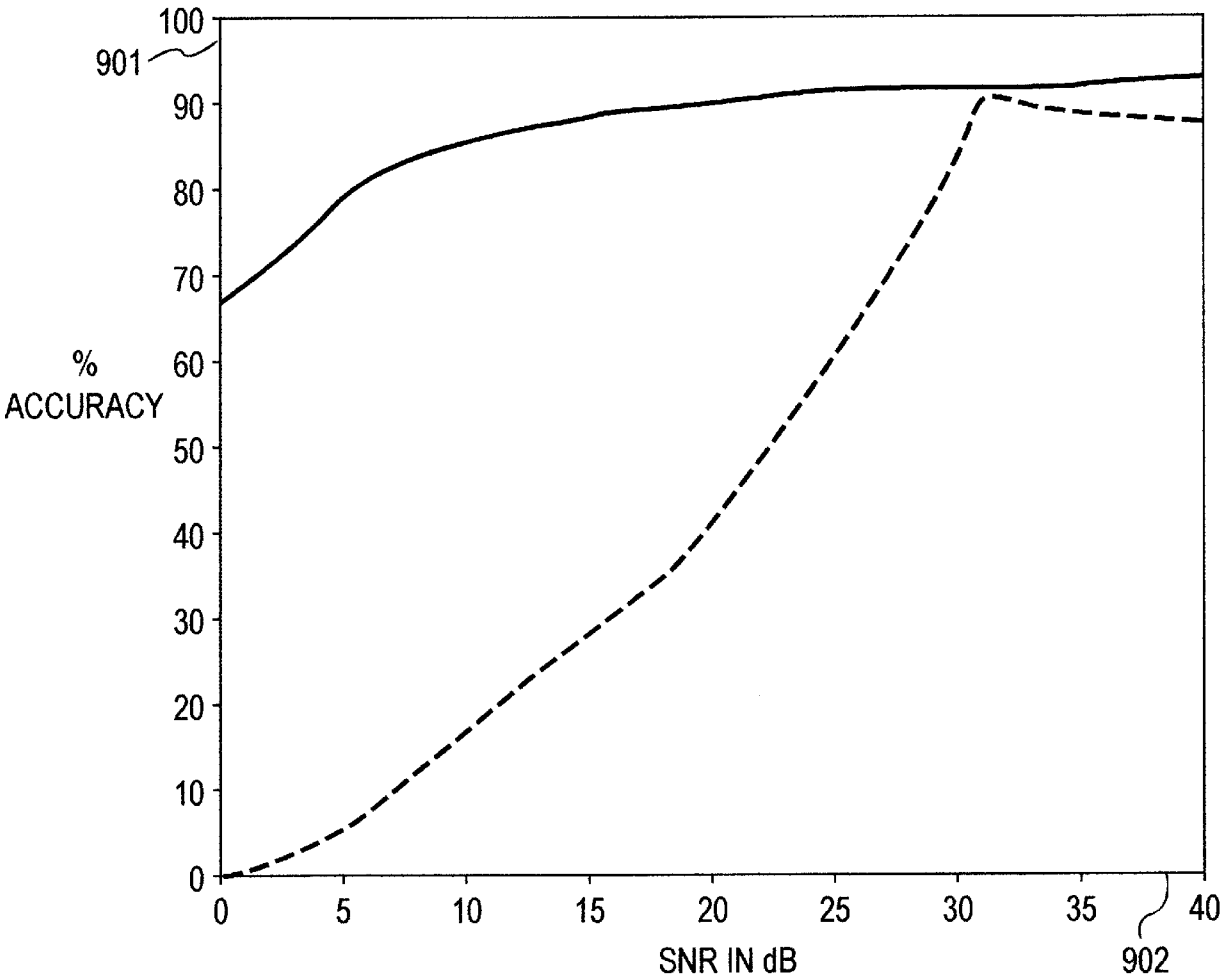
FIG. 9 is a graph comparing the accuracy of speaker recognition methods.

As shown in FIG. 9, experiments suggest that the EM process gives better results than using the ML distance. In FIG. 9, the y-axis 901 is the percentage of accuracy for correctly identifying speakers, and the x-axis indicates different levels of SNR. The curve 910 is for uncompensated speech using ML distance metrics and models trained with clean speech. The curve 920 is for compensated speech at a given measured SNR. For environments with a SNR less than 25 dB as is typically found in homes and offices, there is a marked improvement.

The foregoing description has been directed to specific embodiments of this invention. It will be apparent, however, that variations and modifications. It will be apparent to those skilled in the art that modifications may be made to the described embodiments, with the attainment of all or some of the advantages. Therefore, it is the object of the appended claims to cover all such variations and modifications as come within the spirit and scope of this invention.

We claim:

1. A computerized method for processing speech signals, comprising:

storing first vectors representing clean speech signals in a vector codebook;

determining second vectors from dirty speech signals;

estimating environmental parameters from the second vectors;

predicting third vectors based on the estimated environmental parameters to correct the first vectors;

applying the third vectors to the second vectors to produce corrected vectors; and comparing the corrected vectors and the first vectors to identify first vectors which resemble the corrected vectors;

wherein said method further comprises one of the following two steps: (1) using a search algorithm to determine a hypothesis sequence of phonemes of said first vectors that is statistically closest to a sequence of said corrected vectors, and (2) determining mean and covariance for predicted statistics of said dirty speech signals and measuring likelihood that an utterance was generated by a particular speaker based upon an expectation maximization process.

2. The method of claim 1 wherein the third vectors are stored in the vector codebook.

3. The method of claim 1 further comprising:

determining a distance between a particular corrected vector and a corresponding first vector, the distance representing a likelihood that the corresponding first vector resembles the particular corrected vector.

4. The method of claim 3 further comprising:

maximizing the likelihood that the particular corrected vector resembles the coresponding first vector.

5. The method of claim 3 wherein the likelihood that the corresponding first vector resembles the particular corrected vector is a posterior probability that a particular third vector is represented by the corresponding first vector.

6. The method of claim 1 wherein the comparing step uses a statistical comparison.

7. The method of claim 6 wherein the statistical comparison is based on a minimum mean square error.

8. The method of claim 1 wherein the first vectors represent phonemes of the clean speech, and the comparison step determines the content of the dirty speech to perform speech recognition.

9. The method of claim 1 wherein the first vectors represent models of clean speech of known speakers, and the comparison step determines the identity of an unknown speaker producing the dirty speech signals.

10. The method of claim 1 wherein the dirty speech signals are produced continuously.

11. The method of claim 1 wherein the third vectors are dynamically adapted as the environmental parameters alter the dirty speech signals over time.

12. The method of claim 1 wherein the environmental parameters characterize noise and distortion by the variables Q, H, and $\Sigma_n$.

* * * * *